US011295658B2

(12) United States Patent
Wang

(10) Patent No.: US 11,295,658 B2
(45) Date of Patent: Apr. 5, 2022

(54) DISPLAY PANEL AND DISPLAY DEVICE

(71) Applicant: WUHAN CHINA STAR OPTOELECTONICS SEMICONDUCTOR DISPLAY TECHNOLOGY CO., LTD., Hubei (CN)

(72) Inventor: Lei Wang, Wuhan (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 356 days.

(21) Appl. No.: 16/488,468

(22) PCT Filed: Jul. 10, 2019

(86) PCT No.: PCT/CN2019/095420
§ 371 (c)(1),
(2) Date: Aug. 23, 2019

(87) PCT Pub. No.: WO2020/215495
PCT Pub. Date: Oct. 29, 2020

(65) Prior Publication Data

US 2021/0335191 A1 Oct. 28, 2021

(30) Foreign Application Priority Data

Apr. 26, 2019 (CN) ..... 201910343579.4

(51) Int. Cl.
*G09G 3/20* (2006.01)
*G09G 3/32* (2016.01)

(52) U.S. Cl.
CPC ..... *G09G 3/2074* (2013.01); *G09G 3/32* (2013.01); *G09G 2320/0204* (2013.01); *G09G 2330/08* (2013.01)

(58) Field of Classification Search
CPC .... G09G 3/2074; G09G 3/32; G09G 2330/08; G09G 2320/0204
See application file for complete search history.

(56) References Cited

U.S. PATENT DOCUMENTS

2015/0108437 A1* 4/2015 Cho ..... H01L 27/3248 257/40
2015/0109189 A1 4/2015 Hwang et al.
(Continued)

FOREIGN PATENT DOCUMENTS

CN 104576686 A 4/2015
CN 105513538 A 4/2016
CN 107591086 A 1/2018

*Primary Examiner* — Andrew Sasinowski
(74) *Attorney, Agent, or Firm* — Benesch, Friedlander, Coplan & Aronoff LLP

(57) ABSTRACT

The present invention provides a display panel and a display device. The display panel adds a repair driver circuit, repair switch circuits and a sensing circuit into the circuit of the display panel. When sub-pixel driver circuits of the display panel need compensation, repair switch circuits switch on, a repair driver circuit outputs a corresponding drive signal to sub-pixels to be compensated such that highly efficient and fast auto repair to abnormal pixel points is achieved to mitigate the issue of errors of the driver circuit in the conventional display.

12 Claims, 5 Drawing Sheets

(56) References Cited

U.S. PATENT DOCUMENTS

| | | | |
|---|---|---|---|
| 2016/0104430 | A1 | 4/2016 | Park |
| 2016/0217735 | A1 | 7/2016 | Park et al. |
| 2016/0365070 | A1 | 12/2016 | Park et al. |
| 2018/0012542 | A1 | 1/2018 | Lee et al. |

* cited by examiner

DISPLAY PANEL AND DISPLAY DEVICE

CROSS REFERENCE TO RELATED APPLICATION

This application claims the priority of International Application No. PCT/CN2019/095420, filed on 2019 Jul. 10, which claims priority to Chinese Application No. 201910343579.4 filed on 2019 Apr. 26. The entire disclosures of each of the above applications are incorporated herein by reference.

FIELD OF INVENTION

The present invention relates to a field of displays, especially to a display panel and a display device.

BACKGROUND OF INVENTION

With the development of information technology, various displays have been widely used in people's life work. A display is generally driven by current, and the drive current is provided by the thin film transistor in the driver circuit. However, due to process conditions and material structure, the driver circuit usually has problems of poor circuit and uneven drive current, which affects uniformity of images of the display.

Therefore, the conventional display has an issue of errors of the driver circuit, which needs to be solved.

SUMMARY OF INVENTION

Technical Issue

The present invention provides a display panel and a display device to mitigate existing abnormal issues of a driver circuit of a display.

Technical Solution

To solve the above issue, the present invention provides technical solutions as follows:

The present invention provides a display panel, comprising:

- a display driver circuit, comprising sub-pixel driver circuits disposed in an array, wherein the sub-pixel driver circuits are configured to output drive signals;
- a repair driver circuit, configured to provide sub-pixels with drive signals when the display driver circuit needs compensation;
- repair switch circuits, connecting to a signal output terminal of the repair driver circuit and a signal output terminal of the display driver circuit, and configured to connect the signal output terminal of the repair driver circuit to signal output terminals of the sub-pixel driver circuits to be compensated when the sub-pixel driver circuits need compensation; and
- a sensing circuit, configured to sense a sub-pixel point of the display panel to be compensated.

In the display panel provided by the present invention, the repair driver circuit is disposed in a single column relative to the sub-pixel driver circuits, the repair driver circuit and the sub-pixel driver circuits located in the same row are electrically connected to the same one of scan signal lines, and the repair driver circuit located in the same column are electrically connected to the same one of data signal lines.

In the display panel provided by the present invention, the repair driver circuit is disposed in a single column.

In the display panel provided by the present invention, the repair driver circuit is disposed in a plurality of columns.

In the display panel provided by the present invention, the repair driver circuit is disposed in a row relative to the sub-pixel driver circuits, the repair driver circuit located in the same row is electrically connected to the same one of scan signal lines, and the repair driver circuit and the sub-pixel driver circuits located in the same column are electrically connected to the same one of data signal lines.

In the display panel provided by the present invention, the repair driver circuit is disposed in a single row.

In the display panel provided by the present invention, the repair driver circuit is disposed in a plurality of rows.

In the display panel provided by the present invention, the repair switch circuits are correspondingly disposed with the sub-pixel driver circuits.

In the display panel provided by the present invention, a gate electrode of a switch transistor in the repair switch circuits is electrically connected to a data driver integrated circuit, a switch transistor corresponding to the sub-pixels located in the same column is electrically connected to the same one of data signal lines.

In the display panel provided by the present invention, a gate electrode of a switch transistor in the repair switch circuits is electrically connected to a scan driver circuit, and a switch transistor corresponding to the sub-pixels located in the same row is electrically connected to a scan line.

At the meantime, the present invention also provides a display device comprising a display panel, and the display panel comprises:

- a display driver circuit, comprising sub-pixel driver circuits disposed in an array, wherein the sub-pixel driver circuits are configured to output drive signals;
- a repair driver circuit, configured to provide sub-pixels with drive signals when the display driver circuit needs compensation;
- repair switch circuits, connecting to a signal output terminal of the repair driver circuit and a signal output terminal of the display driver circuit, and configured to connect the signal output terminal of the repair driver circuit to signal output terminals of the sub-pixel driver circuits to be compensated when the sub-pixel driver circuits need compensation; and
- a sensing circuit, configured to sense a sub-pixel point of the display panel to be compensated.

In the display device provided by the present invention, the repair driver circuit is disposed in a single column relative to the sub-pixel driver circuits, the repair driver circuit and the sub-pixel driver circuits located in the same row are electrically connected to the same one of scan signal lines, and the repair driver circuit located in the same column are electrically connected to the same one of data signal lines.

In the display device provided by the present invention, the repair driver circuit is disposed in a single column.

In the display device provided by the present invention, the repair driver circuit is disposed in a plurality of columns.

In the display device provided by the present invention, the repair driver circuit is disposed in a row relative to the sub-pixel driver circuits, and the repair driver circuit located in the same row is electrically connected to the same one of scan signal lines, and the repair driver circuit and the sub-pixel driver circuits located in the same column are electrically connected to the same one of data signal lines.

In the display device provided by the present invention, the repair driver circuit is disposed in a single row.

In the display device provided by the present invention, the repair driver circuit is disposed in a plurality of rows.

In the display device provided by the present invention, the repair switch circuits are correspondingly disposed with the sub-pixel driver circuits.

In the display device provided by the present invention, a gate electrode of a switch transistor in the repair switch circuits is electrically connected to a data driver integrated circuit, a switch transistor corresponding to the sub-pixels located in the same column is electrically connected to the same one of data signal lines.

In the display device provided by the present invention, a gate electrode of a switch transistor in the repair switch circuits is electrically connected to a scan driver circuit, and a switch transistor corresponding to the sub-pixels located in the same row is electrically connected to a scan line.

Advantages

The present invention provides a display panel and a display device, the display panel includes a display driver circuit, a repair driver circuit, repair switch circuits, and a sensing circuit. By adding the repair driver circuit, the repair switch circuits, and the sensing circuit in the circuit of the display panel, when the sub-pixel driver circuits in the display panel need compensation, the sensing circuit senses a sub-pixel point to be compensated, one of the repair switch circuits corresponding to the sub-pixel point to be compensated is conducted, the repair driver circuit outputs a drive signal to the sub-pixel to be compensated such that highly efficient and fast auto repair to abnormal pixel points is achieved to mitigate the issue of errors of the driver circuit in the conventional display.

DESCRIPTION OF DRAWINGS

To more clearly elaborate on the technical solutions of embodiments of the present invention or prior art, appended figures necessary for describing the embodiments of the present invention or prior art will be briefly introduced as follows. Apparently, the following appended figures are merely some embodiments of the present invention. A person of ordinary skill in the art may acquire other figures according to the appended figures without any creative effort.

DETAILED DESCRIPTION OF PREFERRED EMBODIMENTS

Figure 1:
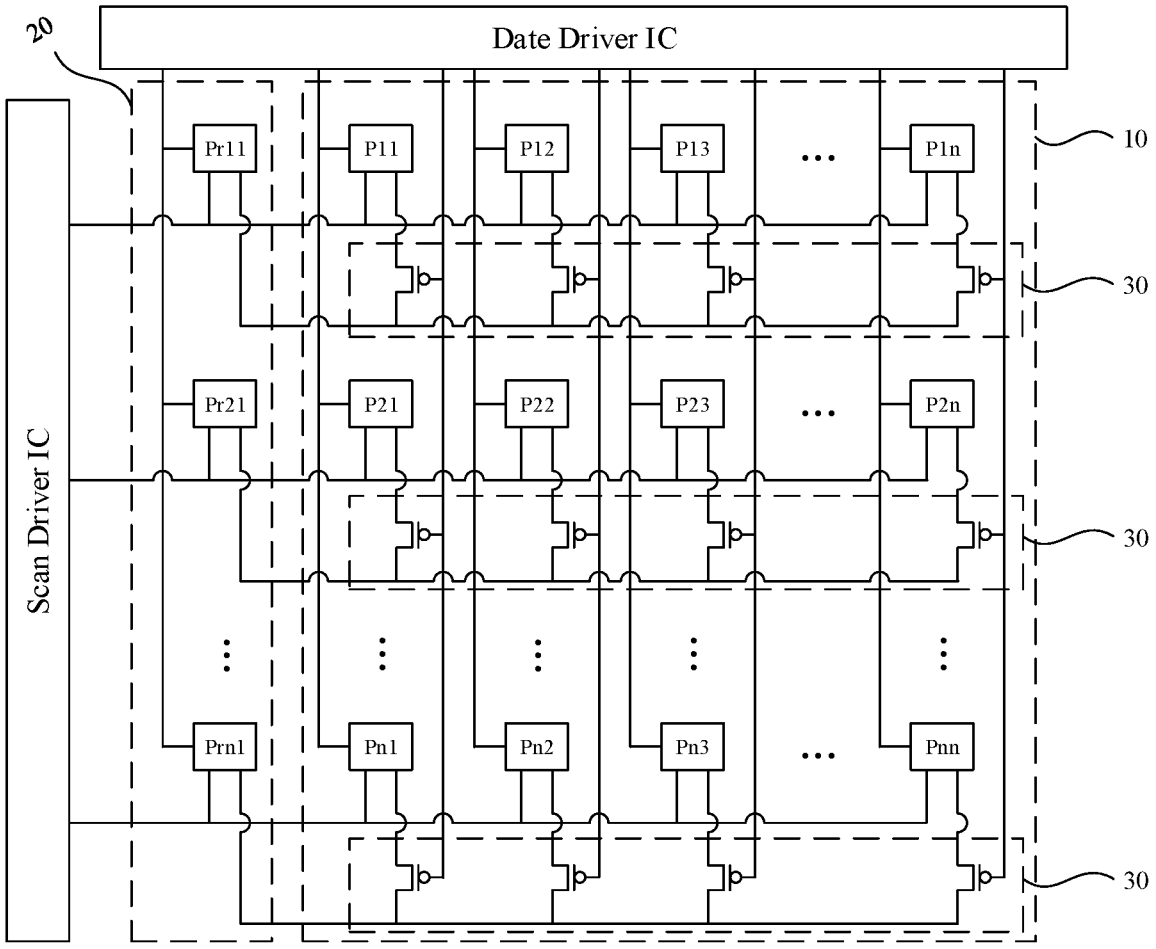
FIG. 1 is a schematic view of structures of a first circuit of a display panel of an embodiment provided by the present invention.

Each of the following embodiments is described with appending figures to illustrate specific embodiments of the present invention that are applicable. The terminologies of direction mentioned in the present invention, such as "upper", "lower", "front", "rear", "left", "right", "inner", "outer", "side surface", etc., only refer to the directions of the appended figures. Therefore, the terminologies of direction are used for explanation and comprehension of the present invention, instead of limiting the present invention. In the figures, units with similar structures are marked with the same reference characters.

In an embodiment, with reference to FIGS. 1 to 4, a display panel provided by the present invention includes:

- a display driver circuit 10, including sub-pixel driver circuits P11 to Pnn disposed in an array, wherein the sub-pixel driver circuits are configured to output drive signals to sub-pixels disposed in an array;
- a repair driver circuit 20, configured to provide the sub-pixels with drive signals when the display driver circuit 10 needs compensation;
- repair switch circuits 30, connecting to a signal output terminal of the repair driver circuit 20 and a signal output terminal of the display driver circuit 10, configured to connect the signal output terminal of the repair driver circuit 20 to signal output terminals of the sub-pixel driver circuits to be compensated when the sub-pixel driver circuits need compensation; and
- a sensing circuit (not shown), configured to sense a sub-pixel point of the display panel to be compensated.

The present invention provides a display panel and a display device, the display panel includes a display driver circuit, a repair driver circuit, repair switch circuits, and a sensing circuit. By adding the repair driver circuit, the repair switch circuits, and the sensing circuit in the circuit of the display panel, when the sub-pixel driver circuits in the display panel need compensation, the sensing circuit senses a sub-pixel point to be compensated, one of the repair switch circuits corresponding to the sub-pixel point to be compensated is conducted, the repair driver circuit outputs a drive signal to the sub-pixel to be compensated such that highly efficient and fast auto repair to abnormal pixel points is achieved to mitigate the issue of errors of the driver circuit in the conventional display.

In an embodiment, with reference to FIG. 1, the repair driver circuit 20 includes sub-repair driver circuits Pr11 to Prn1, repair driver circuit 20 is disposed in a single column relative to the sub-pixel driver circuits. In other words, one row of the sub-pixel circuits corresponds to one of the sub-repair driver circuits. The sub-repair driver circuits or the sub-pixel driver circuits disposed in the same column are electrically connected to a data driver integrated circuit (Data Driver IC) by the same one of data signal lines. The sub-repair driver circuits and the sub-pixel driver circuits disposed in the same row are electrically connected to a scan driver integrated circuit (Scan Driver IC) by the same one of scan signal lines. The repair switch circuits 30 are correspondingly disposed with the sub-pixel driver circuits. A gate electrode of a switch transistor in the repair switch circuits 30 is electrically connected to the data driver integrated circuit, and a switch transistor located in the same column is electrically connected to the same one of data signal lines. The signal output terminals of the sub-pixel driver circuits are electrically connected to the output terminals of the sub-repair driver circuits disposed in the same row through the repair switch circuits.

The scan driver integrated circuit is also called a row driver integrated circuit or a gate electrode driver integrated circuit, and is configured to achieve switching of the array of the thin film transistors row by row, and to achieve inputting of data signals of a switched column to corresponding pixels under control signals with cooperation of the data driver integrated circuit.

The data driver integrated circuit is also called a source driver integrated circuit, and is mainly configured to receive digital video data signals and control signals provided by front timing controller, and to convert digital signals into corresponding analog grayscale voltage signals by digital to analog conversion and input the analog grayscale voltage signals into corresponding pixels such that illumination and brightness of the pixels are controlled.

In the above embodiment, the sub-repair driver circuits and the sub-pixel driver circuits located in the same row are controlled by the same one of scan signal lines to switch on or off. When the sub-pixel driver circuits of the row in which sub-repair driver circuits the are located operate normally, the repair switch circuit corresponding to the sub-pixel driver circuits is switched off, the sub-repair driver circuits are broken circuits and provide the sub-pixels with no drive signal. When the sub-pixel circuits of the row in which the sub-repair driver circuits are located are abnormal and need compensation, the repair switch circuits corresponding to the sub-pixel driver circuits are switched on, and the sub-repair driver circuits output drive signals to the abnormal sub-pixels by output terminals of the abnormal sub-pixel driver circuits.

The drive signals outputted by the repair driver circuit to the abnormal sub-pixels are controller by the data driver integrated circuit. In the same row, when a single abnormal sub-pixel driver circuit appears, an output signal of the repair driver circuit is a drive signal corresponding to the abnormal sub-pixel; when a plurality of abnormal sub-pixel driver circuits appear, the output signal of the repair driver circuit is an average value of the drive signals corresponding to the abnormal sub-pixels.

In the embodiment as shown in FIG. 1, sub-repair driver circuits are disposed without repair switch circuits, because the repair driver circuit is disposed in a single column. In other words, the rows of the sub-pixel circuits correspond to the sub-repair driver circuits, and the repair switch circuits of the sub-pixel driver circuits can control output terminals of the sub-repair driver circuits to be electrically connected to output terminals of the sub-pixel driver circuits one to one or one to many such that a number of the repair switch circuits of the sub-repair driver circuits can be lowered. Of course, repair switch circuits can be disposed on the repair driver circuit such that the repair switch circuits further control switch on and off of the repair driver circuit.

The connection way of the circuit of the repair switch circuits 30 is not limited in the way as shown in FIG. 1, and can be that a gate electrode of a switch transistor in the repair switch circuits 30 is electrically connected to the data driver integrated circuit, and a switch transistor located in the same column is electrically connected to the same one of data signal lines such that the data driver integrated circuit controls switch on or off of the switch transistor.

In the above embodiment, repair driver circuit 20 can be disposed in a non-displaying region of the display panel, or can be disposed in a displaying region of the display panel.

Figure 2:
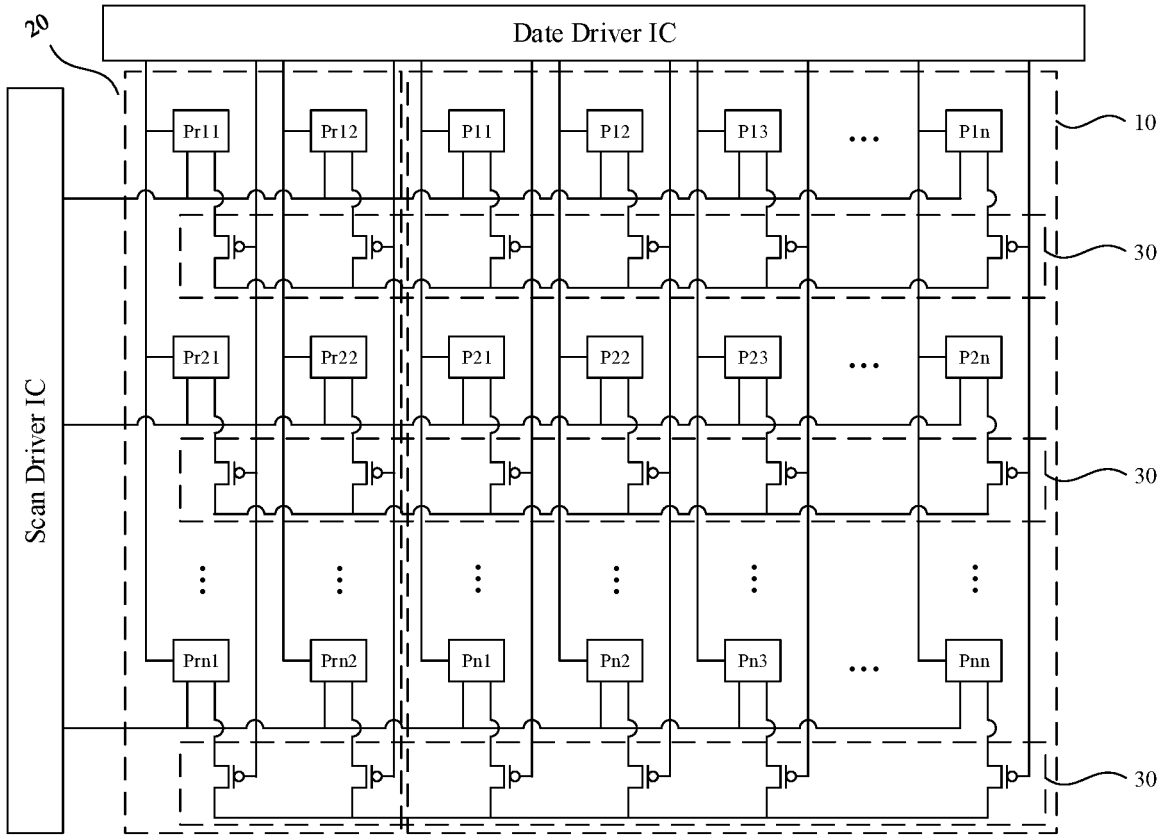
FIG. 2 is a schematic view of structures of a second circuit of the display panel of the embodiment provided by the present invention.

In another embodiment, with reference to FIG. 2, the repair driver circuit 20 includes sub-repair driver circuits Pr11 to Prn2, repair driver circuit 20 is disposed in two columns relative to the sub-pixel driver circuits. In other words, one row of the sub-pixel circuits corresponds to two sub-repair driver circuits. The sub-repair driver circuits or the sub-pixel driver circuits disposed in the same columns, by the same one of data signal lines electrically connected to the data driver integrated circuit (Data Driver IC), the sub-repair driver circuits and the sub-pixel driver circuits disposed in the same row are electrically connected to the scan driver integrated circuit (Scan Driver IC) by the same one of scan signal lines. The repair switch circuits 30 are correspondingly disposed with the sub-pixel driver circuits. A gate electrode of a switch transistor of the repair switch circuits 30 is electrically connected to the data driver integrated circuit, and a switch transistor located in the same column is electrically connected to the same one of data signal lines, output terminals of the sub-pixel driver circuits are electrically connected to output terminals of the sub-repair driver circuits disposed in the same row by corresponding repair switch circuits.

In the above embodiment, the sub-repair driver circuits and the sub-pixel driver circuits located in the same row are controlled by the same one of scan signal lines to switch on or off. When the sub-pixel driver circuits of the row in which sub-repair driver circuits the are located operate normally, the repair switch circuit corresponding to the sub-pixel driver circuits is switched off, the sub-repair driver circuits are broken circuits and provide the sub-pixels with no drive signal. When the sub-pixel circuits of the row in which the sub-repair driver circuits are located are abnormal and need compensation, the repair switch circuits corresponding to the sub-pixel driver circuits are switched on, and the sub-repair driver circuits output drive signals to the abnormal sub-pixels by output terminals of the abnormal sub-pixel driver circuits.

In the embodiment as shown in FIG. 2, two sub-repair driver circuits simultaneously control compensation of a row of the sub-pixel driver circuits. In the same row, when a single abnormal sub-pixel driver circuits appears, one sub-repair driver circuit can provide the abnormal sub-pixel with drive signal. When a plurality of abnormal sub-pixel driver circuits appear, two sub-repair driver circuits can provide the abnormal sub-pixels with drive signals. Two columns of the repair driver circuit simultaneously implement repair compensation to the sub-pixel driver circuits such that work load of each column of the repair driver circuit can be eased while an issue of not able to repair and compensate the abnormal sub-repair driver circuits due to a single column of the repair driver circuit can be avoided.

Furthermore, the two columns of the repair driver circuit are not limited in the disposing way as shown in FIG. 2, and it can be that two sub-repair driver circuits located in the same row control compensation of some of the sub-pixel driver circuits in the row respectively. For example, one column of the sub-repair driver circuits is electrically connected to some of the sub-pixel driver circuits on a left side in the figure, the other column of the sub-repair driver circuits is electrically another some of the sub-pixel driver circuits on a right side in the figure. Therefore, more efficient repair compensation of batches of the sub-pixel driver circuits can be achieved.

Similarly, the wire connection way of the repair switch circuits 30 is also not limited by the disposing way as shown in FIG. 2, and it can be that a gate electrode of a switch transistor in the repair switch circuits 30 is electrically connected to the data driver integrated circuit, and a switch transistor located in the same column is electrically connected to the same one of data signal lines. The data driver integrated circuit controls switch on and off of the switch transistor.

In the above embodiment, the repair driver circuit 20 can be disposed in a non-displaying region of the display panel, or can be disposed in a displaying region of the display panel. Alternatively, one column of the repair driver circuit 20 can be disposed in the non-displaying region of the display panel, another column of the repair driver circuit 20 can be disposed in the displaying region of the display panel.

In still another embodiment, the repair driver circuit 20 is disposed in a plurality of columns relative to the sub-pixel driver circuits. The columns can be about three columns, and the working principle thereof can be similar to that of two columns which can refer to the above embodiment and will not be described in details herein.

Figure 3:
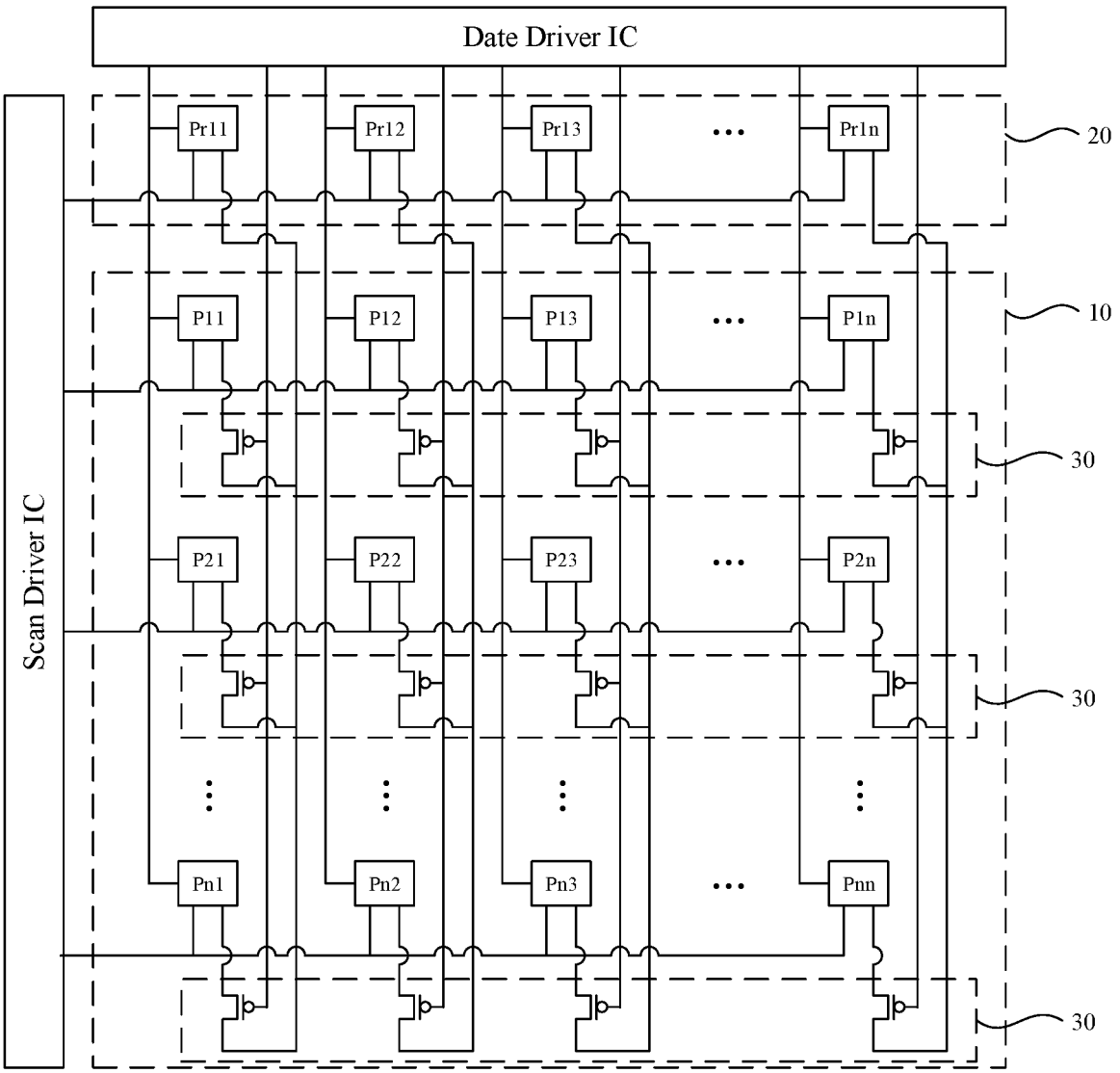
FIG. 3 is a schematic view of structures of a third circuit of the display panel of the embodiment provided by the present invention.

In an embodiment, with reference to FIG. 3, the repair driver circuit 20 includes sub-repair driver circuits Pr11 to Pr1*n*. The repair driver circuit 20 is disposed in a single column relative to the sub-pixel driver circuits. In other words, the column sub-pixel circuits are correspondingly disposed with the sub-repair driver circuits. The sub-repair driver circuits and the sub-pixel driver circuits disposed in the same column are electrically connected to the data driver integrated circuit (Date Driver IC) by the same one of data signal lines. The sub-repair driver circuits or the sub-pixel driver circuits disposed in the same row are electrically connected to the scan driver integrated circuit (Scan Driver IC) by the same one of scan signal lines. The repair switch circuits 30 are correspondingly disposed with the sub-pixel driver circuits. a gate electrode of a switch transistor of the repair switch circuits 30 is electrically connected to the data driver integrated circuit, and a switch transistor located in the same column is electrically connected to the same one of data signal lines, output terminals of the sub-pixel driver circuits are electrically connected to output terminals of the sub-repair driver circuits disposed in the same row by corresponding repair switch circuits.

In the above embodiment, when the sub-pixel driver circuits of the row in which sub-repair driver circuits the are located operate normally, the repair switch circuit corresponding to the sub-pixel driver circuits is switched off, the sub-repair driver circuits are broken circuits and provide the sub-pixels with no drive signal. When the sub-pixel circuits of the row in which the sub-repair driver circuits are located are abnormal and need compensation, the repair switch circuits corresponding to the sub-pixel driver circuits are switched on, and the sub-repair driver circuits output drive signals to the abnormal sub-pixels by output terminals of the abnormal sub-pixel driver circuits.

Because the sub-repair driver circuits and the sub-pixel driver circuits of the same column commonly use the same data signal line, i.e., their input data signals are the same to excellently ensure that when corresponding abnormal sub-pixel circuits are compensated, the compensating drive signals are the needed drive signals for the pixel points to normally operate.

In the embodiment as shown in FIG. 3, the sub-repair driver circuits are disposed without the repair switch circuits, which is similar to the working principle of the single column of the repair driver circuit as shown in FIG. 1 such that a number of the repair switch circuits of the sub-repair driver circuits can be lowered. Of course, repair switch circuits can be disposed on the repair driver circuit such that the repair switch circuits further control switch on and off of the repair driver circuit.

The wire connection way of the repair switch circuits 30 is also not limited by the disposing way as shown in FIG. 3, and it can be that a gate electrode of a switch transistor in the repair switch circuits 30 is electrically connected to the data driver integrated circuit, and a switch transistor located in the same column is electrically connected to the same one of data signal lines. The data driver integrated circuit controls switch on and off of the switch transistor.

In the above embodiment, the repair driver circuit 20 can be disposed in a non-displaying region of the display panel, or can be disposed in a displaying region of the display panel.

Figure 4:
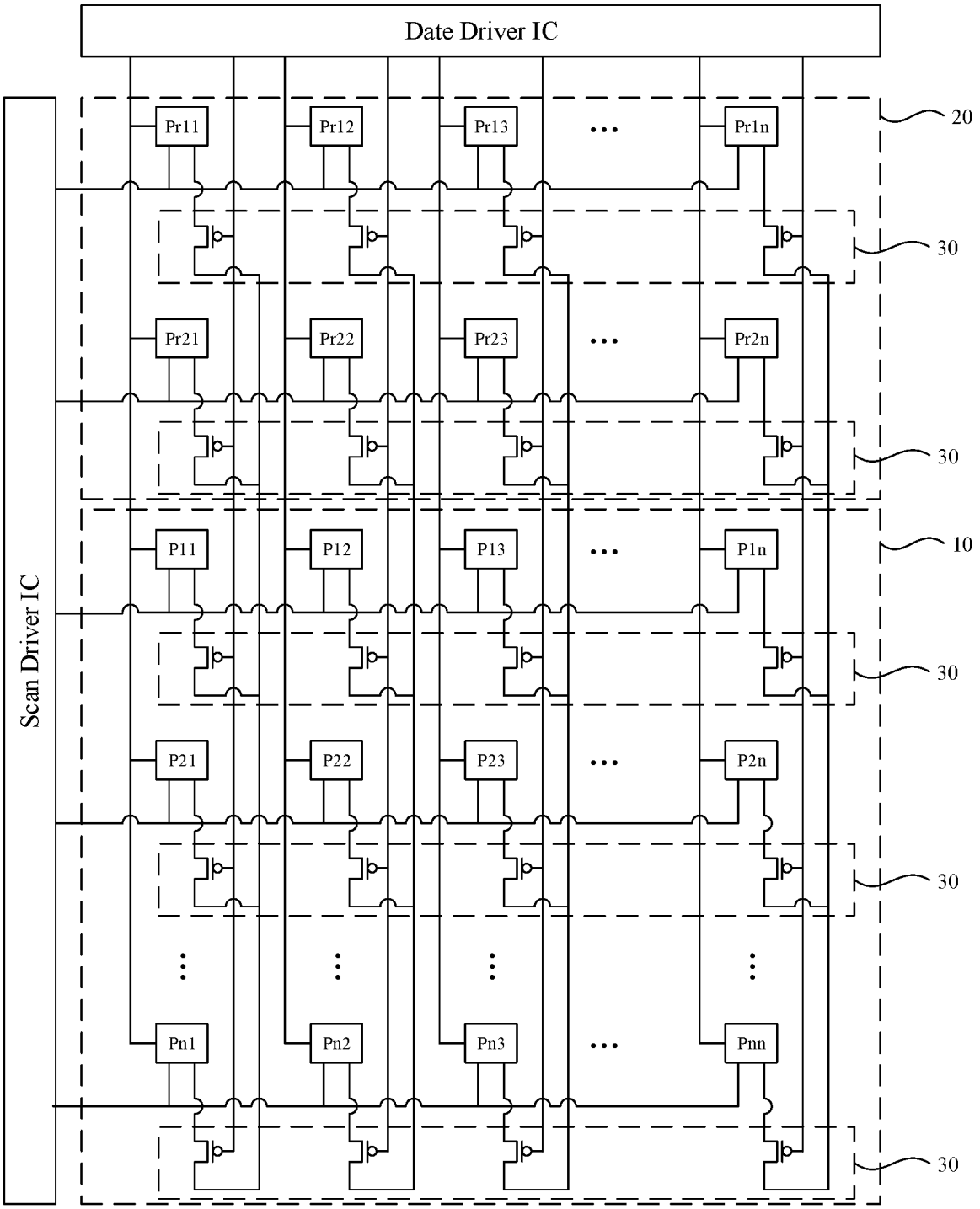
FIG. 4 is a schematic view of structures of a fourth circuit of the display panel of the embodiment provided by the present invention.

In another embodiment, with reference to FIG. 4, repair driver circuit 20 includes sub-repair driver circuits Pr11 to Pr2*n*, repair driver circuit 20 is disposed in two rows relative to the sub-pixel driver circuits. In other word, one column sub-pixel circuit corresponds to two sub-repair driver circuits. The sub-repair driver circuits and the sub-pixel driver circuits disposed in the same column are electrically connected to the data driver integrated circuit (Date Driver IC) by the same one of data signal lines. The sub-repair driver circuits or the sub-pixel driver circuits disposed in the same row are electrically connected to the scan driver integrated circuit (Scan Driver IC) by the same one of scan signal lines. The repair switch circuits 30 are correspondingly disposed with the sub-pixel driver circuits and are correspondingly disposed with the sub-repair driver circuits. A gate electrode of a switch transistor of the repair switch circuits 30 is electrically connected to the data driver integrated circuit, and a switch transistor located in the same column is electrically connected to the same one of data signal lines, output terminals of the sub-pixel driver circuits are electrically connected to output terminals of the sub-repair driver circuits disposed in the same row by corresponding repair switch circuits.

In the above embodiment, when the sub-pixel driver circuits of the row in which sub-repair driver circuits the are located operate normally, the repair switch circuit corresponding to the sub-pixel driver circuits is switched off, the sub-repair driver circuits are broken circuits and provide the sub-pixels with no drive signal. When the sub-pixel circuits of the row in which the sub-repair driver circuits are located are abnormal and need compensation, the repair switch circuits corresponding to the sub-pixel driver circuits are switched on, and the sub-repair driver circuits output drive signals to the abnormal sub-pixels by output terminals of the abnormal sub-pixel driver circuits.

In the embodiment as shown in FIG. 4, two sub-repair driver circuits simultaneously control compensation of one column sub-pixel driver circuits. Two columns of the repair driver circuit simultaneously implement repair compensation to the sub-pixel driver circuits such that work load of each column of the repair driver circuit can be eased while an issue of not able to repair and compensate the abnormal sub-repair driver circuits due to a single column of the repair driver circuit can be avoided.

The wire connection way of the repair switch circuits 30 is also not limited by the disposing way as shown in FIG. 2, and it can be that a gate electrode of a switch transistor in the repair switch circuits 30 is electrically connected to the data driver integrated circuit, and a switch transistor located in the same column is electrically connected to the same one of data signal lines. The data driver integrated circuit controls switch on and off of the switch transistor.

In the above embodiment, the repair driver circuit 20 can be disposed in a non-displaying region of the display panel, or can be disposed in a displaying region of the display panel. Alternatively, one column of the repair driver circuit 20 can be disposed in the non-displaying region of the display panel, another column of the repair driver circuit 20 can be disposed in the displaying region of the display panel.

In still another embodiment, the repair driver circuit 20 is disposed in a plurality of columns relative to the sub-pixel driver circuits. The columns are about three columns, and the working principle thereof is similar to that of two columns which can refer to the above embodiment and will not be described in details herein.

In an embodiment, repair driver circuit 20 are correspondingly disposed with the sub-pixel driver circuits. The working principle thereof is similar to that of plural columns which can refer to the above embodiment and will not be described in details herein.

Main parts in the display driver circuit 10, the repair driver circuit 20, and the repair switch circuits 30 are thin film transistors, and thin film transistors are classified into P-type transistors and N-type transistors. The thin film transistors in the repair driver circuit 20 are differently disposed relative to the repair switch circuits 30, and working voltages thereof are different during the repair and compensation of the display panel.

In an embodiment, the repair transistors in the repair driver circuit 20 are P-type transistors, and the switch transistors in the repair switch circuits are P-type transistors. When the sensing circuit senses bands or points of the abnormal sub-pixels, a scan signal voltage and a data signal voltage of a repair transistor corresponding to a sub-pixel point to be compensated are both in low potentials, and a gate electrode of a switch transistor corresponding to the sub-pixel point to be compensated is in a low potential.

In another embodiment, repair transistors in the repair driver circuit 20 are P-type transistors, and switch transistors in the repair switch circuits are N-type transistors. When the sensing circuit senses bands or points of the abnormal sub-pixels, a scan signal voltage and a data signal voltage of a repair transistor corresponding to a sub-pixel point to be compensated are both in low potentials, and a gate electrode of a switch transistor corresponding to the sub-pixel point to be compensated is in a high potential.

In still another embodiment, repair transistors of the repair driver circuit are N-type transistors, and switch transistors in the repair switch circuits are N-type transistors. When the sensing circuit senses bands or points of the abnormal sub-pixels, a scan signal voltage and a data signal voltage of a repair transistor corresponding to a sub-pixel point to be compensated are both in high potentials, and a gate electrode of a switch transistor corresponding to the sub-pixel point to be compensated is in a high potential.

In still an embodiment, repair transistors in the repair driver circuit are N-type transistors, switch transistors in the repair switch circuits are P-type transistors. When the sensing circuit senses bands or points of the abnormal sub-pixels, a scan signal voltage and a data signal voltage of a repair transistor corresponding to a sub-pixel point to be compensated are both in high potentials, and a gate electrode of the switch transistor corresponding to the sub-pixel point to be compensated is in a low potential.

Figure 5:
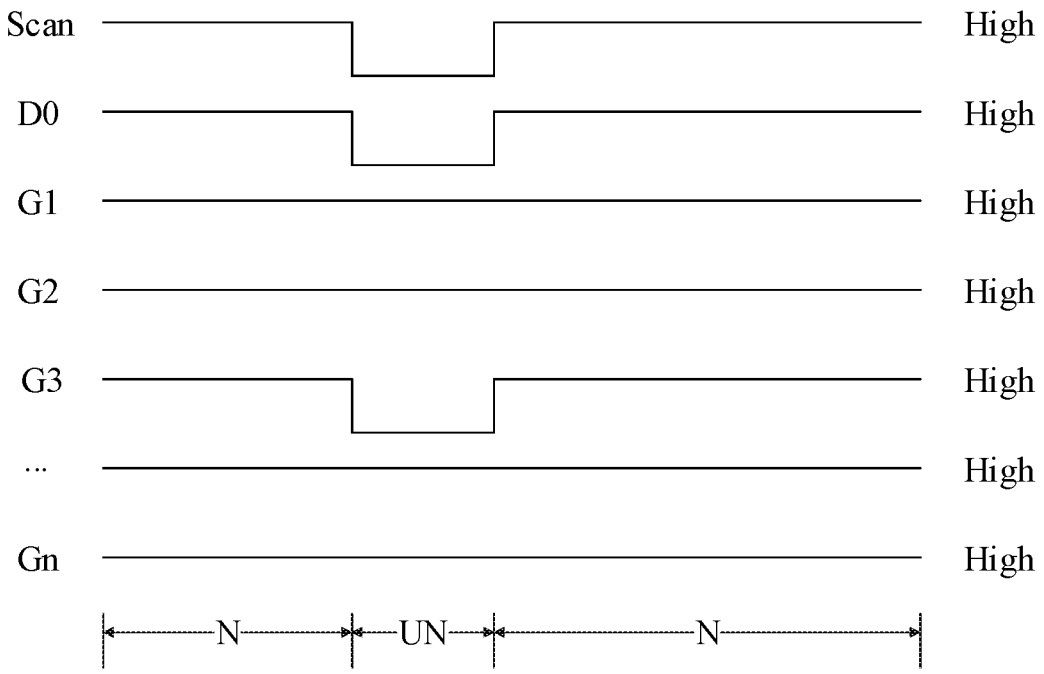
FIG. 5 is a working time chart of the display of the embedment provided by the present invention.

It will be described with combination a specific embodiment and the display panel provided by the embodiment of the present invention. Taking the embodiment shown in FIG. 1 as an example, the repair driver circuit 20 and the repair switch circuits shown in the figure both employ P-type transistors, and a working time chart is as shown in FIG. 5.

When the display panel operates normally, the scan drive voltage is in a high potential, and the repair driver circuit switches off. A data drive voltage DO of the repair driver circuit is in a high potential, and no drive signal is outputted. Data drive voltages G1 to Gn of the repair switch circuits are all in high potentials, and the repair switch circuits switch off. Furthermore, the data drive voltage G1 to Gn of the repair switch circuits are all in low potentials, the repair switch circuits switch on, but however the repair driver circuit switches off and cannot output compensating drive signals.

When the sensing circuit senses an abnormal pixel point P23, 將 position of the abnormal pixel point and compensating drive signals needed for the abnormal pixel point to operate normally are transmitted to the data driver integrated circuit (Date Driver IC) and the scan driver integrated circuit (Scan Driver IC). The scan driver integrated circuit drives the scan drive voltage to be in a low potential, and the repair driver circuit switches on. The data driver integrated circuit drives the data drive voltage DO of the repair driver circuit to be in a low potential and outputs a drive signal, the drive signal is a compensating drive signal needed for the sub-pixels P23 to work normally. Furthermore, the data driver integrated circuit can also stop the output of drive signal of the driver circuit of the sub-pixels P23 and simultaneously drives the repair driver circuit to output a drive signal needed for the sub-pixels P23 to operate normally. The data driver integrated circuit drives a data drive voltage G3 of the repair switch circuits corresponding to the sub-pixels P23 to be in a low potential, and the repair switch circuits switch on. Electrical connection of the output terminal of the repair driver circuit with the output terminals of the driver circuit of the sub-pixels P23 achieves compensation work to the drive signal of the abnormal sub-pixels P23 of the display panel.

At the meantime, the present invention embodiment provides a display device including a display panel, and the display panel includes:

a display driver circuit, comprising sub-pixel driver circuits disposed in an array, wherein the sub-pixel driver circuits are configured to output drive signals;

a repair driver circuit, configured to provide sub-pixels with drive signals when the display driver circuit needs compensation;

repair switch circuits, connecting to a signal output terminal of the repair driver circuit and a signal output terminal of the display driver circuit, and configured to connect the signal output terminal of the repair driver circuit to signal output terminals of the sub-pixel driver circuits to be compensated when the sub-pixel driver circuits need compensation; and a sensing circuit, configured to sense a sub-pixel point of the display panel to be compensated.

The present embodiment provides the display device, and the working principle thereof is similar to that of the display panel of the above embodiment which can refer to the above embodiment and will not be described in details herein.

The present invention embodiment provides a display device, the display panel includes a display driver circuit, a repair driver circuit, repair switch circuits, and a sensing circuit. By adding the repair driver circuit, the repair switch circuits, and the sensing circuit in the circuit of the display panel, when the sub-pixel driver circuits in the display panel need compensation, the sensing circuit senses a sub-pixel point to be compensated, one of the repair switch circuits corresponding to the sub-pixel point to be compensated is conducted, the repair driver circuit outputs a drive signal to the sub-pixel to be compensated such that highly efficient and fast auto repair to abnormal pixel points is achieved to mitigate the issue of errors of the driver circuit in the conventional display.

It should be known in the above embodiment that:

The present invention provides a display panel and a display device. The display panel includes a display driver circuit, a repair driver circuit, repair switch circuits, and a sensing circuit. By adding the repair driver circuit, the repair switch circuits, and the sensing circuit in the circuit of the display panel, when the sub-pixel driver circuits in the display panel need compensation, the sensing circuit senses a sub-pixel point to be compensated, one of the repair switch circuits corresponding to the sub-pixel point to be compensated is conducted, the repair driver circuit outputs a drive signal to the sub-pixel to be compensated such that highly efficient and fast auto repair to abnormal pixel points is achieved to mitigate the issue of errors of the driver circuit in the conventional display.

Although the preferred embodiments of the present invention have been disclosed as above, the aforementioned preferred embodiments are not used to limit the present invention. The person of ordinary skill in the art may make various changes and modifications without departing from the spirit and scope of the present invention. Therefore, the scope of protection of the present invention is defined by the scope of the claims.

What is claimed is:

1. A display panel, comprising:

a display driver circuit, comprising sub-pixel driver circuits disposed in an array, wherein the sub-pixel driver circuits are configured to output drive signals;

a repair driver circuit, configured to provide sub-pixels with drive signals when the display driver circuit needs compensation;

repair switch circuits, connecting to a signal output terminal of the repair driver circuit and a signal output terminal of the display driver circuit, and configured to connect the signal output terminal of the repair driver circuit to signal output terminals of the sub-pixel driver circuits to be compensated when the sub-pixel driver circuits need compensation; and a sensing circuit, configured to sense a sub-pixel point of the display panel to be compensated;

wherein the repair driver circuit is disposed in a single column relative to the sub-pixel driver circuits, the repair driver circuit and the sub-pixel driver circuits located in the same row are electrically connected to the same one of scan signal lines, and the repair driver circuit located in the same column are electrically connected to the same one of data signal lines.

2. The display panel as claimed in claim 1, wherein the repair driver circuit is disposed in a single column.

3. The display panel as claimed in claim 1, wherein the repair driver circuit is disposed in a plurality of columns.

4. The display panel as claimed in claim 1, wherein the repair switch circuits are correspondingly disposed with the sub-pixel driver circuits.

5. The display panel as claimed in claim 4, wherein a gate electrode of a switch transistor in the repair switch circuits is electrically connected to a data driver integrated circuit, a switch transistor corresponding to the sub-pixels located in the same column is electrically connected to the same one of data signal lines.

6. The display panel as claimed in claim 4, wherein a gate electrode of a switch transistor in the repair switch circuits is electrically connected to a scan driver circuit, and a switch transistor corresponding to the sub-pixels located in the same row is electrically connected to a scan line.

7. A display panel, comprising:

a display driver circuit, comprising sub-pixel driver circuits disposed in an array, wherein the sub-pixel driver circuits are configured to output drive signals;

a repair driver circuit, configured to provide sub-pixels with drive signals when the display driver circuit needs compensation;

repair switch circuits, connecting to a signal output terminal of the repair driver circuit and a signal output terminal of the display driver circuit, and configured to connect the signal output terminal of the repair driver circuit to signal output terminals of the sub-pixel driver circuits to be compensated when the sub-pixel driver circuits need compensation; and a sensing circuit, configured to sense a sub-pixel point of the display panel to be compensated;

wherein the repair driver circuit is disposed in a row relative to the sub-pixel driver circuits, the repair driver circuit located in the same row is electrically connected to the same one of scan signal lines, and the repair driver circuit and the sub-pixel driver circuits located in the same column are electrically connected to the same one of data signal lines.

8. The display panel as claimed in claim 7, wherein the repair driver circuit is disposed in a single row.

9. The display panel as claimed in claim 7, wherein the repair driver circuit is disposed in a plurality of rows.

10. A display device, comprising a display panel, the display panel comprising:

a display driver circuit, comprising sub-pixel driver circuits disposed in an array, wherein the sub-pixel driver circuits are configured to output drive signals;

a repair driver circuit, configured to provide sub-pixels with drive signals when the display driver circuit needs compensation;

repair switch circuits, connecting to a signal output terminal of the repair driver circuit and a signal output terminal of the display driver circuit, and configured to connect the signal output terminal of the repair driver circuit to signal output terminals of the sub-pixel driver circuits to be compensated when the sub-pixel driver circuits need compensation; and a sensing circuit, configured to sense a sub-pixel point of the display panel to be compensated;

wherein the repair driver circuit is disposed in a single column relative to the sub-pixel driver circuits, the repair driver circuit and the sub-pixel driver circuits located in the same row are electrically connected to the same one of scan signal lines, and the repair driver circuit located in the same column are electrically connected to the same one of data signal lines.

11. The display device as claimed in claim 10, wherein the repair driver circuit is disposed in a single column.

12. The display device as claimed in claim 10, wherein the repair driver circuit is disposed in a plurality of columns.

* * * * *